US006382464B1

(12) United States Patent
Uzawa

(10) Patent No.: US 6,382,464 B1
(45) Date of Patent: May 7, 2002

(54) CUP TYPE AUTOMATIC VENDING MACHINE

(75) Inventor: Takashi Uzawa, Tokyo (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/773,089

(22) Filed: Jan. 31, 2001

(51) Int. Cl.[7] ..... B67D 5/08
(52) U.S. Cl. ..... 222/64; 222/129.1; 222/159
(58) Field of Search ..... 222/129.1, 146.6, 222/159, 26, 64

(56) References Cited

U.S. PATENT DOCUMENTS 3,583,601 A * 6/1971 Ayers ..... 222/129.1
5,490,614 A * 2/1996 Sardynski ..... 222/146.6
5,730,330 A * 5/1998 Reading ..... 222/129.1
5,772,319 A * 6/1998 Pemberton et al. ..... 222/159
5,931,343 A * 8/1999 Topar et al. ..... 222/413

* cited by examiner

*Primary Examiner*—Philippe Derakshani
(74) *Attorney, Agent, or Firm*—Fish & Richardson P.C.

(57) ABSTRACT

A sales volume for at least a cup of syrup is secured in a down-stream side of a sold-out case 22 of a syrup supplying system, whereby the cup type automatic vending machine can be provided which has excellent washability and inspection ability of syrup existence, and in which construction of the syrup supplying system is simplified.

4 Claims, 8 Drawing Sheets

| | | | |
|---|---|---|---|
| 7 | Cooling water vessel | 22C | Pipe connecting portion |
| 15 | Syrup tank | 22D | Electrode supporting portion |
| 15A | Gas Introduction portion | 23 | Cooling coil |
| 15B | Syrup sending portion | 24 | Pipe |
| 21 | Pipe | 25 | Flow rate regulator |
| 22 | Sold-out case | 26 | Electromagnetic valve |
| 22A | Pipe connecting portion | W | Cooling water |
| 22B | Main body | | |

| | | | |
|---|---|---|---|
| 7 | Cooling water vessel | 22C | Pipe connecting portion |
| 15 | Syrup tank | 22D | Electrode supporting portion |
| 15A | Gas Introduction portion | 23 | Cooling coil |
| 15B | Syrup sending portion | 24 | Pipe |
| 21 | Pipe | 25 | Flow rate regulator |
| 22 | Sold-out case | 26 | Electromagnetic valve |
| 22A | Pipe connecting portion | W | Cooling water |
| 22B | Main body | | |

| | | | |
|---|---|---|---|
| 22 | Sold-out case | 22Q | Gas releasing portion |
| 22K | Pipe connecting material | 22R | Flowing path |
| 22L | Introduction portion | 22S | Sealing material |
| 22M | Casing main body | 22T | Sealing material |
| 22N | Siphon pipe | 22U | Top end portion |
| 22O | Sending portion | 22V | Gas exhausting portion |
| 22P | Syrup sensor | | |

FIG.3

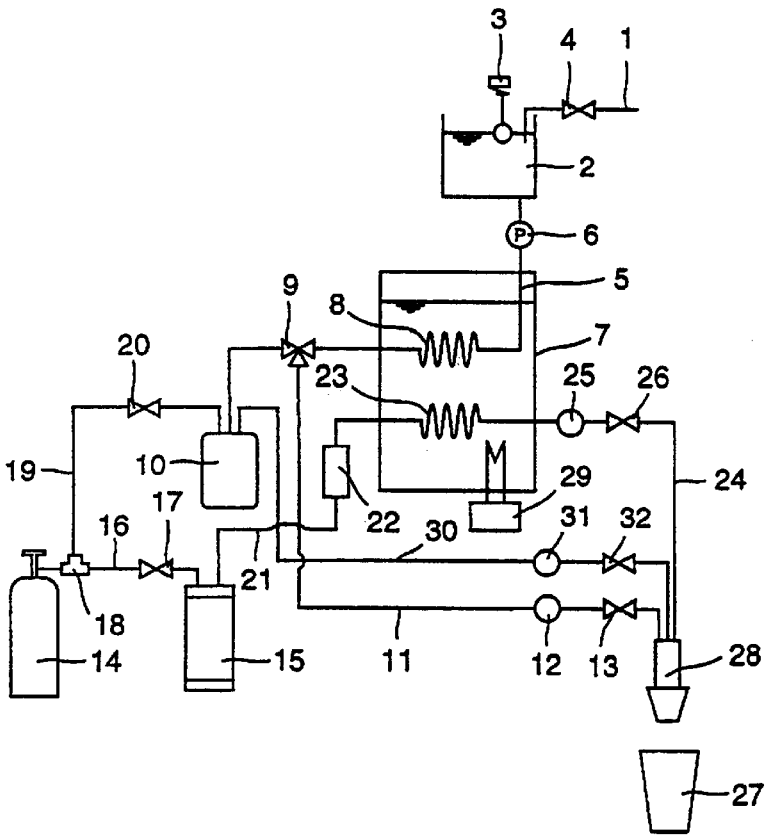

1 Water introducing pipe
2 Cistern
3 Float switch
4 Water supply electromagnetic valve
5 Pipe
6 Pump
7 Cooling water vessel
8 Cooling coil
9 Three way valve
10 Carbonator
11 Pipe
12 Flow rate regulator
13 Electromagnetic valve
14 Gas cylinder (or gas spray can)
15 Syrup tank
16 Gas pipe
17 Gas valve
18 Gas manifold
19 Gas pipe
20 Gas valve
21 Pipe
22 Sold-out case
23 Cooling coil
24 Pipe
25 Flow rate regulator
26 Electromagnetic valve
27 Cup
28 Supply nozzle
29 Cooler
30 Pipe
31 Flow rate regulator
32 Electromagnetic valve 7 Cooling water vessel
15 Syrup tank
15A Gas Introduction portion
15B Syrup sending portion
21 Pipe
22 Sold-out case
22A Pipe connecting portion
22B Main body
22C Pipe connecting portion
22D Electrode supporting portion
23 Cooling coil
24 Pipe
25 Flow rate regulator
26 Electromagnetic valve
W Cooling water

| | | | |
|---|---|---|---|
| 22 | Sold-out case | 22F | Electrode |
| 22A | Pipe connecting portion | 23 | Nut |
| 22B | Main body | 22H | Sealing material |
| 22C | Pipe connecting portion | 22K | Pipe connecting material |
| 22D | Electrode supporting portion | $d_1$ | Inner diameter of pipe connecting material 22K |
| 22E | Syrup flowing path | $d_2$ | Inner diameter of syrup flowing path 22E |

7 Cooling water vessel
15 Syrup tank
15A Gas Introduction portion
15B Syrup sending portion
21 Pipe
22 Sold-out case
22A Pipe connecting portion
22B Main body
22C Pipe connecting portion
22D Electrode supporting portion
23 Cooling coil
24 Pipe
25 Flow rate regulator
26 Electromagnetic valve
W Cooling water

| | | | |
|---|---|---|---|
| 22 | Sold-out case | 22F | Electrode |
| 22A | Pipe connecting portion | 23 | Nut |
| 22B | Main body | 22H | Sealing material |
| 22C | Pipe connecting portion | 22K | Pipe connecting material |
| 22D | Electrode supporting portion | $d_1$ | Inner diameter of pipe connecting material 22K |
| 22E | Syrup flowing path | $d_2$ | Inner diameter of syrup flowing path 22E |

7 Cooling water vessel
15 Syrup tank
15A Gas Introduction portion
15B Syrup sending portion
21 Pipe
22 Sold-out case
22A Pipe connecting portion
22B Main body
22C Pipe connecting portion
22D Electrode supporting portion
23 Cooling coil
24 Pipe
25 Flow rate regulator
26 Electromagnetic valve
W Cooling water

CUP TYPE AUTOMATIC VENDING MACHINE

FIELD OF THE INVENTION

The present invention relates to a cup type automatic vending machine, and more particularly, relates to a cup type vending machine in which operations for a syrup exchange can be reduced and of which structure can be simplified.

BACKGROUND OF THE INVENTION

A cup type automatic vending machine for preparing a cup type drink by mixing a syrup as a material with a drink water or carbonated water has been known.

In FIG. 1, a syrup supplying system in a conventional cup type automatic vending machine is shown, which comprises a syrup tank 15 storing a syrup, a sold-out case 22 to inspect existence of syrup to be supplied via a pipe 21 from the syrup tank 15, a cooling coil 23 connected to a down stream side of the sold-out case 22 and dipped in a cooling water W stored in a cooling water vessel 7, a flow rate regulator 12 for controlling a flow rate of the syrup and to be connected to the cooling coil 23, and an electromagnetic valve 13 connected to the flow rate regulator 12 through a pipe 24 and which opens and closes according to the syrup supplying operation.

The syrup tank 15 has a gas introduction portion 15A connected to a gas cylinder (not shown) storing carbon dioxide gas therein and a syrup sending portion 15B to send a syrup according to a gas pressure of carbon dioxide gas. The electromagnetic valve 13 opens according to a syrup supplying indication to be output from a control portion (not shown) and the syrup is sent to the pipe 21 connected to the syrup sending portion 15B.

In FIG. 2, a conventional sold-out case 22 is shown, which comprises an introduction portion 22L to introduce a syrup in the case 22 from a pipe (not shown) installed in a lower part of the case 22 and connected to a pipe connecting material 22K, a cylindrical casing main body 22M, a sending portion 220 installed in an upper part of the case 22 and to send the syrup stored in the case 22 through a siphon pipe 22N, a syrup sensor 22P attached to the sending portion 220 and to inspect existence of the syrup in the case 22, and a gas releasing portion 22Q connected to the sending portion 220 by a screw. In the case, 70 cc of the syrup can be stored which is a volume necessary for sale of a cup.

The sold-out case 22 has such fill-in, fill-out structure that a syrup to be introduced into the case at a time of sales operation of the cup type drinks is lead through a flowing path 22R to the upper portion of the case, and is sent through the siphon pipe 22N from the sending portion 220. A sealing material 22S is installed in connecting positions of the introduction portion 22L, casing main body 22M and sending portion 220 to prevent them from a liquid leakage. A sealing material 22T is installed between the gas releasing portion 22Q and the sending portion 220 to prevent them from a gas leakage. The syrup sensor 22P includes a pair of electrodes to be immersed in the syrup in the case 22 and can inspect a sold-out of syrup when a liquid level of syrup is lowered to expose the electrodes from the syrup, whereby an electricity is turned off. The gas releasing portion 22Q can form a clearance between a top end portion 22U and the sending portion 220 by rotation of it, whereby a gas exhausting portion 22V is connected to the case through the clearance to exhaust a carbonator to be accumulated in the case.

According to the sold-out case, sales operation per one cup of syrup can be done after a sold-out of syrup, because a syrup of another one cup is stored in the case.

However, according to a conventional cup type automatic vending machine, a flowing path and a siphon pipe are installed in a syrup case to realize a fill-in, fill-out operation and as a result, case and piping structure are complicated. And, there are another problems that much amount of washing water and much time are necessary for washing operation to change a kind of syrup. Also, existence of syrup can not be correctly inspected in syrup of a high gas absorption rate, because air bubbles are generated by change of flowing rate based on change in cross-section area of the flowing path and are contact with a syrup sensor to make it move erroneously. Further, the case is bigger because a fixed volume of syrup is stored in the case in order to guarantee a cup of sales volume after the inspection of the sold-out.

SUMMARY OF THE INVENTION

It is, therefore, an object of the invention to install a cup type automatic vending machine which has more improved washability and inspection accuracy of syrup existence.

The object of the invention can be achieved by a cup type vending machine for selling a syrup drink to be supplied from a syrup storing portion to store the syrup through a supplying path to a supplying nozzle comprising a syrup inspection portion to inspect existence of the syrup installed in a certain position of the supplying path which has a syrup supply volume corresponding to a sales volume of at least one cup between the syrup inspection portion and the supplying nozzle.

According to the cup type automatic vending machine of the invention, the number of parts for the supplying path can be reduced and the structure thereof can be simplified because a cup of syrup which is a sales volume is hold in the supplying path between the syrup inspection portion and the supplying nozzle.

BRIEF DESCRIPTION OF THE DRAWING

FIG. 3 is an explanatory drawing showing a cup type automatic vending machine having a syrup supplying system which is an embodiment of the invention.

DESCRIPTION OF THE PREFERRED EMBODIMENTS

Figure 1:
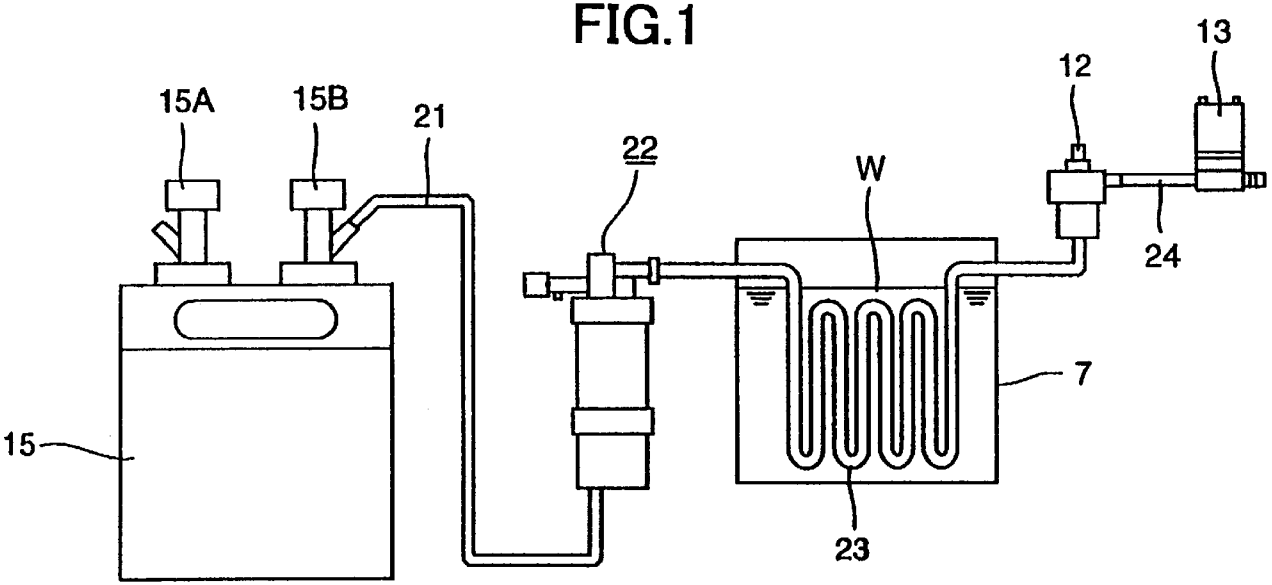
FIG. 1 is an explanatory drawing showing a conventional syrup supplying system.
Figure 2:
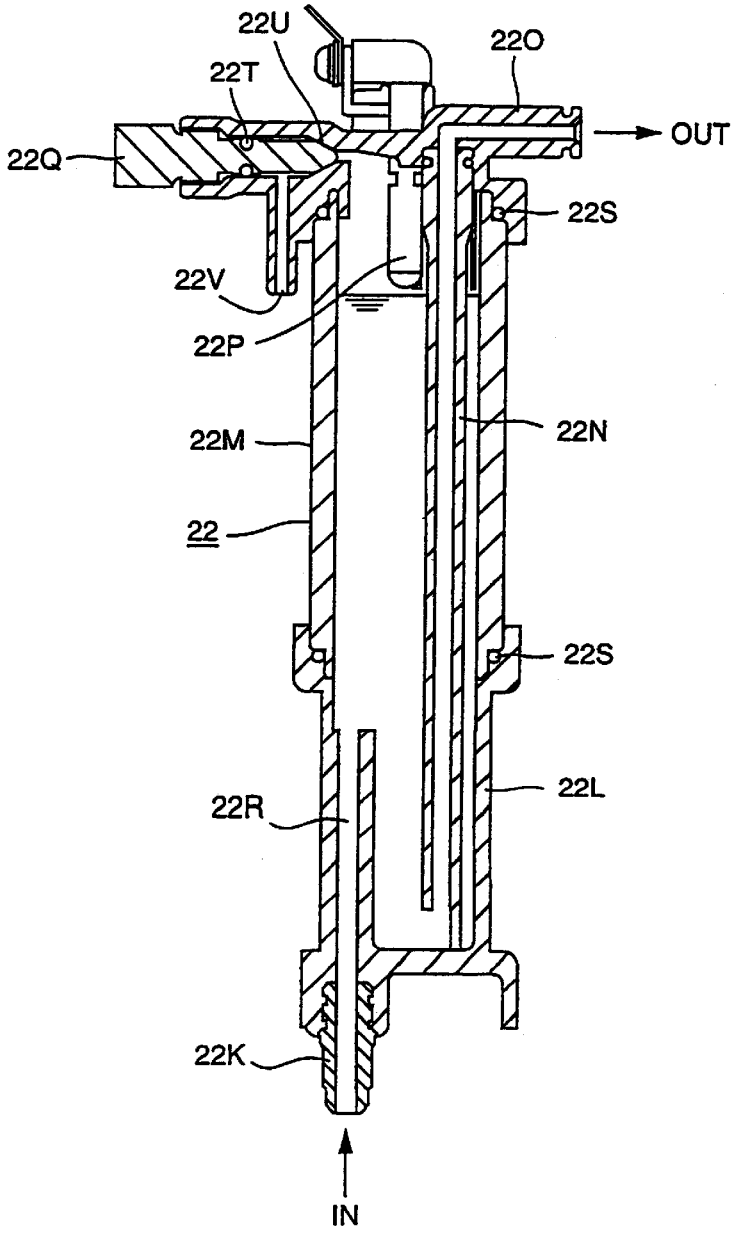
FIG. 2 is a cross-sectional view showing a conventional sold-out case.

A cup type automatic vending machine of the invention will be explained in detail by referring to the drawings.

A cup type automatic vending machine which is a first embodiment of the invention is shown in FIG. 3 comprises a cistern 2 in which drink water is supplied from a water introducing pipe 1, a float switch 3 to output a water level reduction signal by inspecting a level reduction of drink water stored in the cistern 2, a water supply electromagnetic valve 4 which opens or closes according to the output signal of water level reduction, a pump 6 installed in a pipe 5 which is connected to down stream side of the cistern 2, a cooling coil 8 connected to the pipe 5 and dipped in a cooling water W which is stored in a cooling water vessel 7, a three way valve 9 installed in a branched portion of the pipe 5, a carbonator 10 to produce a carbonated water by dissolving a carbon dioxide gas supplied from a gas cylinder described below in water supplied from the cistern 2 through the three way valve 9, a flow rate regulator 12 installed in a pipe 11 branched from the three way valve 9, an electromagnetic valve 13 which opens or closes according to an operation of supplying drink water, a gas cylinder 14 to store carbon dioxide gas, a gas pipe 16 connecting the gas cylinder 14 and a syrup tank 15, a gas valve 17 installed in the gas pipe, a gas pipe 19 connected from the gas pipe 16 through a gas manifold 18 to the carbonator 10, a gas valve 20 installed in the gas pipe 19, a sold-out case 22 installed in a pipe 21 connected to the syrup tank 15 to inspect existence of syrup passing through the pipe 21, a cooling coil 23 installed in a down stream side of the sold-out case 22 and dipped in the cooling water W stored in the cooling water vessel 7, a pipe 24 connected to the cooling coil 23, a flow rate regulator 25 to adjust a flowing rate of syrup, an electromagnetic valve 26 to be opened or closed based on the supply operation of syrup, a supply nozzle 28 installed at the end of the pipes 11, the pipe 24 and a pipe 30 described below and to supply a liquid such syrup, drink water or carbonator to a cup 27, a cooler 29 to cool the cooling water W stored in the cooling water vessel 7 at a fixed temperature, a pipe 30 to supply the carbonated water from the carbonator 10 to the supply nozzle 28, a flow rate regulator 31 installed in the pipe 30 and to adjust a flow rate of carbonated water, and an electromagnetic valve 32 to be opened or closed based on the supply operation of the carbonated water, said carbonated water stored in the carbonator 10 being cooled by a cooler (not shown).

Figure 4:
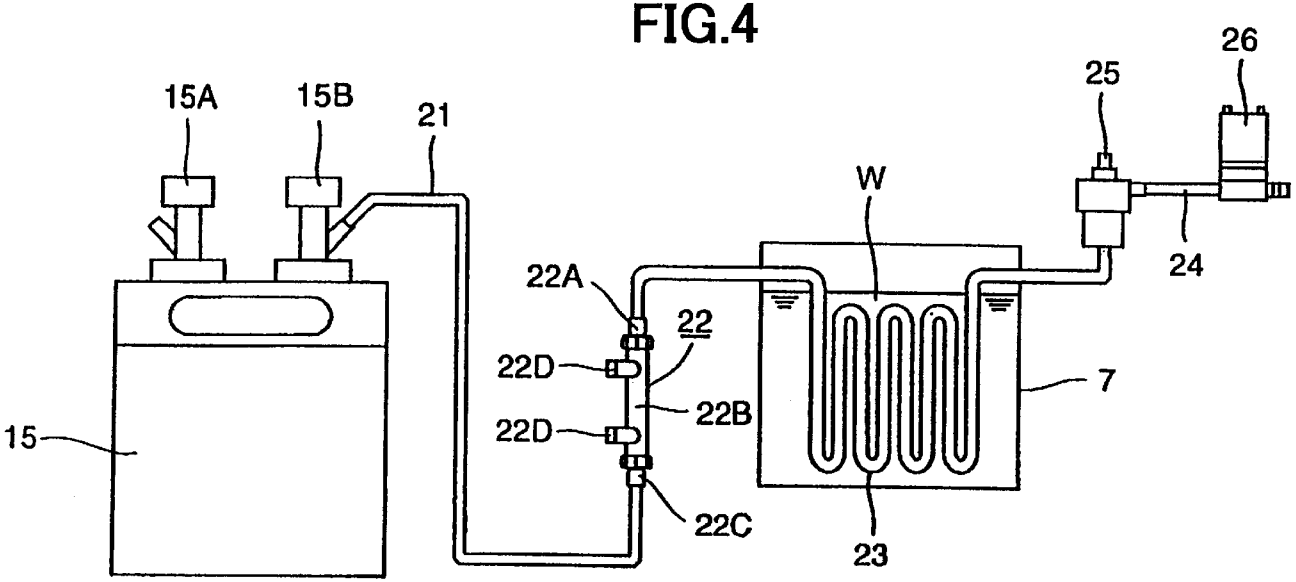
FIG. 4 is an explanatory drawing showing a syrup supplying system of a cup type automatic vending machine which is a first embodiment of the invention.

A syrup supplying system in the cup type automatic vending machine which is the first embodiment of the invention is shown in FIG. 4 and comprises a syrup tank 15 to store a syrup, a sold-out case 22 connected through a pipe 21 to the syrup tank 15 and having pipe connecting portions 22A, 22C, a casing main body 22B and an electrode supporting portion 22D, a cooling coil 23 connected to a down stream side of the sold-out case and dipped in a cooling water W stored in a cooling water vessel 7, a flow rate regulator 25 to adjust a flowing rate of syrup, and an electromagnetic valve 26 connected through a pipe 24 to the flow rate regulator 25 and to be opened or closed based on the supply operation of syrup, the main body 22B in the sold-out case 22 being formed by a transparent resin material so that the syrup passing in the case 22 can be watched by naked eyes. In the syrup supplying system, a specific sales volume (e.g. 150 cc) for a cup of drinks to be sold is secured between the sold-out case 22 and the electromagnetic valve 26. An example of each volume in each portion between them is shown in Table 1.

TABLE 1

| Portion | Volume (cc) |
|---|---|
| Pipe 21 | 30 |
| Sold-out case 22 | 4 |
| Cooling coil 23 | 70 |

TABLE 1-continued

| Portion | Volume (cc) |
|---|---|
| Flow rate regulator 25 | 5 |
| Pipe 24 | 3.0 |
| Electromagnetic valve 26 | 0.4 |

Figure 5:
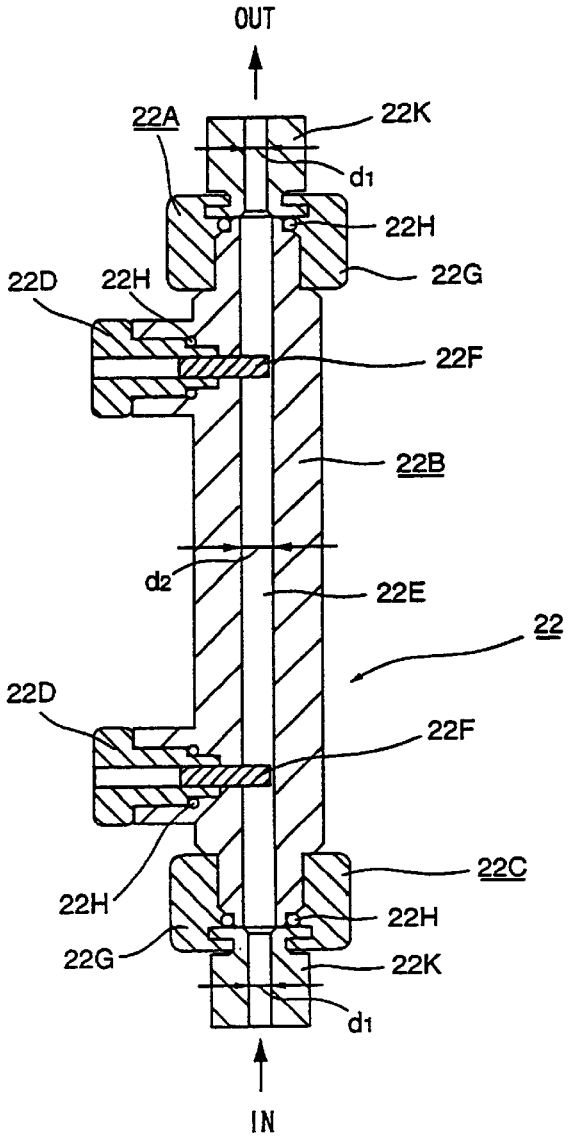
FIG. 5 is a cross-sectional view showing a sold-out case which is a first embodiment of the invention.

A sold-out case 22 in the cup type automatic vending machine which is the first embodiment of the invention is shown in FIG. 5 is provided with a pair of electrodes 22F installed on the tip of an electrode supporting portion 22D inserted in the case main body 22B and extruded in a syrup flowing path 22E in which it is contact with syrup. In pipe connecting portions 22A, 22C, a pipe connecting material 22K is fixed to the main body 22B by a nut. A relationship of an inner diameter $d_2$ of the syrup flowing path 22E to an inner diameter $d_1$ of the pipe connecting material 22K is set so that a cross-section area of the syrup flowing path 22E is not more than three (3) times as large as a cross-section area of the pipe connecting material 22K.

The electrodes 22F are connected to a syrup inspecting circuit (not shown) through a lead line inserted in an inner portion of the electrode supporting portion 22D (not shown) A sealing material 22H is installed in the connecting portion of the pipe connecting portions 22A, 22C and the main body 22B, and in the inserting portion of the electrode supporting portion 22D in order to protect them from liquid leakage.

A syrup supplying operation of the aforementioned cup type automatic vending machine can be done by opening a gas valve 17 installed in a gas pipe 16 connecting a gas cylinder 14 to a syrup tank 15, and by supplying the syrup tank 15 with a carbon dioxide gas.

Syrup is sent from the syrup tank 15 through the pipe 21 to the sold-out case 22 under pressure of carbon dioxide gas and is passed through the pipe connecting material 22K connected to the pipe 21 in the syrup flowing path 22E. When syrup exists between the pair of electrodes 22F extruded in the syrup flowing path 22E, electricity flows which is inspected by a current inspecting portion (not shown) to indicate the existence of syrup. When no syrup exists between the electrodes, no electricity flows therebetween to indicate no existence of syrup. When the remaining volume of syrup is reduced, bubble of carbon dioxide gas is introduced in the syrup to be sent from the syrup tank 15 to the pipe 21. In the case, the electric flow between the electrodes is often cut. In case that liquid is passed through the path and pipe, the liquid flow is disturbed by change of liquid flowing rate if a difference of inner diameter therebetween. In such turbulent flow state, carbon dioxide gas incorporated in syrup is separated from syrup to generate bubble, whereby the syrup inspecting ability of the pair of electrodes 22F is reduced. The change of flowing rate is controlled by setting the relationship of inner diameter $d_2$ of the syrup flowing path 22E to inner diameter $d_1$ of the pipe connecting material 22K so that a cross-section area of the syrup flowing path 22E is not more than three (3) times as large as cross-section area of the pipe connecting material 22K, whereby the reduction of the syrup inspecting ability can be prevented.

For example, in case that the cross-section area of the syrup flowing path 22E is six (6) times as large as cross-section area of the pipe connecting material 22K and syrup having a higher absorbing property of carbon dioxide gas is passed through the path under the pressure of the carbon dioxide gas, the flow of syrup is disturbed in the portion where the inner diameters are different from each other and as a result, bubbles are generated.

Syrup passed through the sold-out case 22 is cooled by a cooling coil 23, and is sent to a supplying nozzle 28 at a flowing rate set by a flow rate regulator based on the opening operation of an electromagnetic valve 26. This syrup is mixed in the supplying nozzle 28 with a drink water supplied through the pipe 11 based on the three-way valve, and the mixture is supplied into a cup which is sold as a cup type drink. In case of carbonated drink, syrup is mixed in the supplying nozzle 28 with a carbonated water supplied from the carbonator 10 through a pipe 30 and the mixture is supplied into a cup which is sold as a cup type drink. In case that carbonated drink is middle or weak carbonated drink, a fixed volume of drink water in accordance with gas volume of cup type drink to be sold is supplied through the pipe 11 and mixed with in the supplying nozzle 28.

In case that a kind of syrup to be supplied is changed, a service connector (not shown) of the carbonator 10 is connected to the syrup sending portion 15B of the syrup tank 15, the gas valve 20 is opened to supply the carbon dioxide gas, and then the electromagnetic valve 26 is opened to supply the carbonated water from the carbonator 10 to the pipe 21 and the inner portion of the pipe is washed. After washing, the service connector (not shown) of the carbonator 10 is taken off and a service connector (not shown) of the gas cylinder 14 is connected to the syrup sending portion 15B and the gas valve 20 is opened to supply the carbon dioxide gas to the pipe 21, whereby the liquid in the pipe is removed.

According to the cup type automatic vending machine as described above, the number of parts to make the sold-out case 22 is reduced (that is, structure of it is simplified) and a cost of the machine is reduced, because the volume of syrup is secured in accordance with the sales volume for one cup in the whole piping arrangement of the syrup supplying system. Also, it is controlled that the flow of syrup is disturbed in the syrup passing by setting a relationship of the inner diameter $d_2$ of the syrup flowing path 22E to the inner diameter $d_1$ of the pipe connecting material 22K so that the cross-section area of the syrup flowing path 22E is not more than three (3) times as large as the cross-section area of the pipe connecting material 22K. As a result, error operations in the electrodes 22F do not cause by the bubbles generated in syrup based on the change of flowing rate in the syrup flowing path 22E, the washability with the washing water sent out under pressure at the washing step of the syrup flowing path 22E is increased, and a short time washing operation of the sold-out case 22 and the syrup supplying system becomes possible without much washing water. In case of the syrup supplying system having the sold-out case 22 as described above, a washing time for one circuit is 35 seconds and can be reduced to a half in comparison with a siphon type sold-out case. As is apparent from the above explanation, a flavor change of the cup type drinks to be sold can be easier by improvement in the washablity of the sold-out case 22 and the syrup supplying system.

Figure 6:
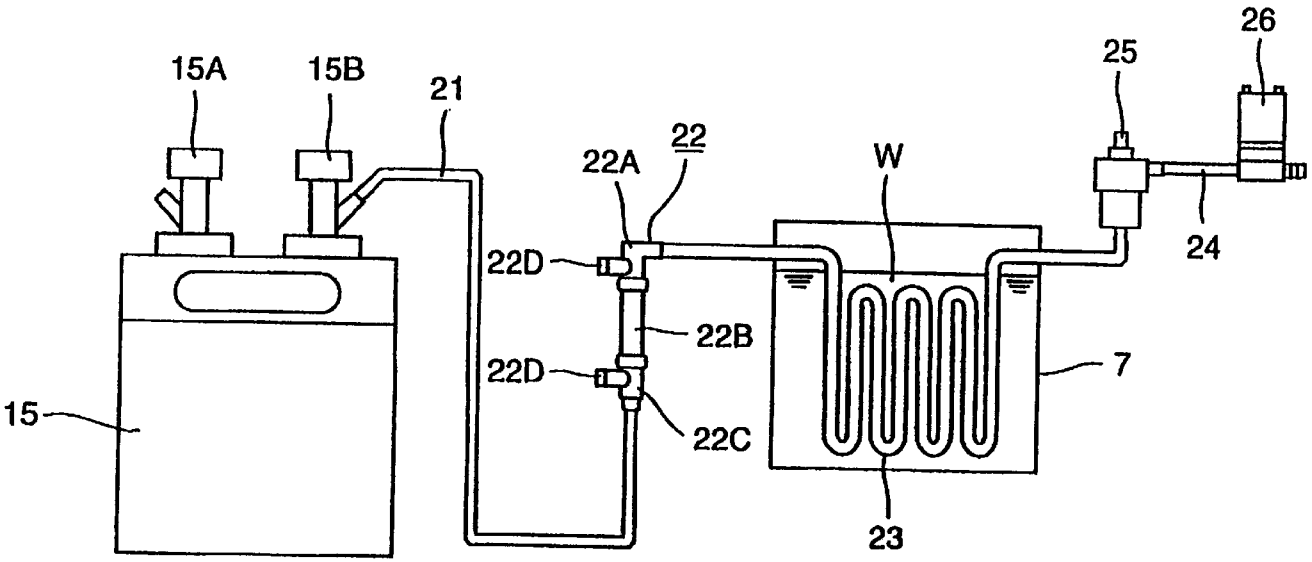
FIG. 6 is an explanatory drawing showing a syrup supplying system of a cup type automatic vending machine which is a second embodiment of the invention.

A syrup supplying system of the second embodiment in the invention shown in FIG. 6 is same as the system of the first embodiment except the sold-out case 22 in which the electrode supporting portion 22D is installed in the pipe connecting portions 22A, 22C and the pipe connecting portion 22A is bent to L-shape.

Figure 7:
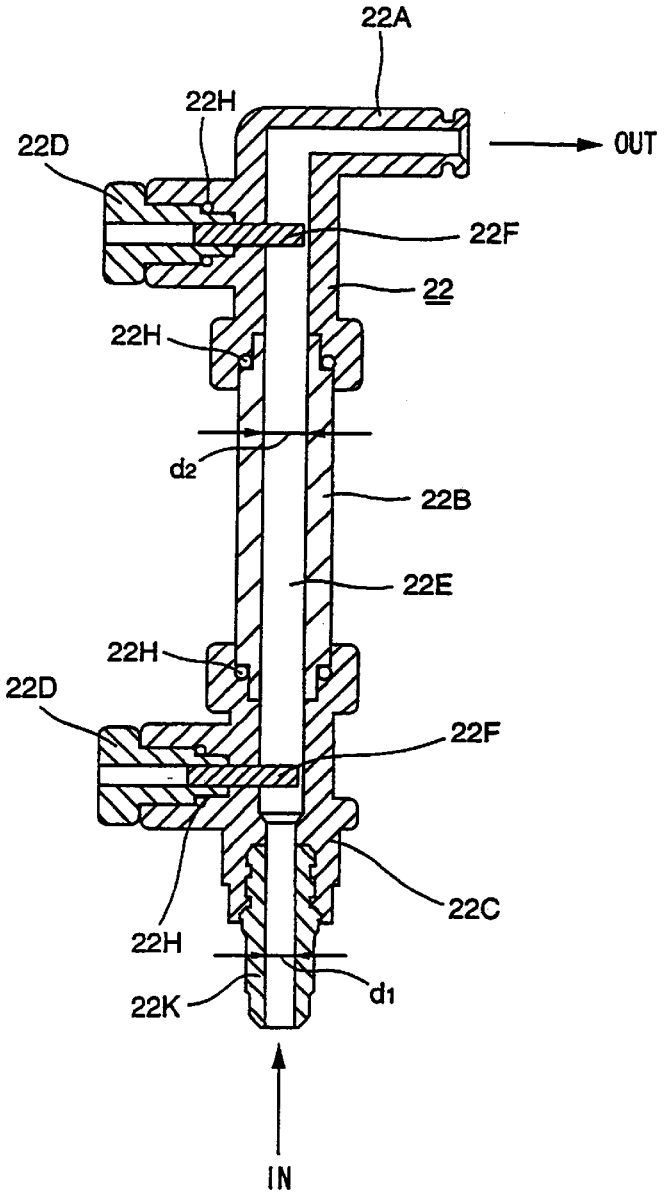
FIG. 7 is a cross- sectional view showing a sold-out case which is a second embodiment of the invention.

A sold-out case 22 of the second embodiment in the invention shown in FIG. 7 has a pair of electrodes 22F which is installed at the tip of an electrode supporting portion 22D and is extruded in a syrup flowing path 22E to be contacted with syrup. A relationship of an inner diameter $d_2$ of the syrup flowing path 22E to an inner diameter $d_1$ of the pipe connecting material 22K installed in the pipe connecting portion 22C is set so that a difference of $\pi(d_2/2)^2$ and $\pi(d_1/2)^2$ in a cross-section area of the path is not more than three (3) times. The syrup flowing path 22E is bent to L-shape in the pipe connecting portion 22A so that syrup sent to the down-stream side under pressure may not be reversed by its weight.

Figure 8:
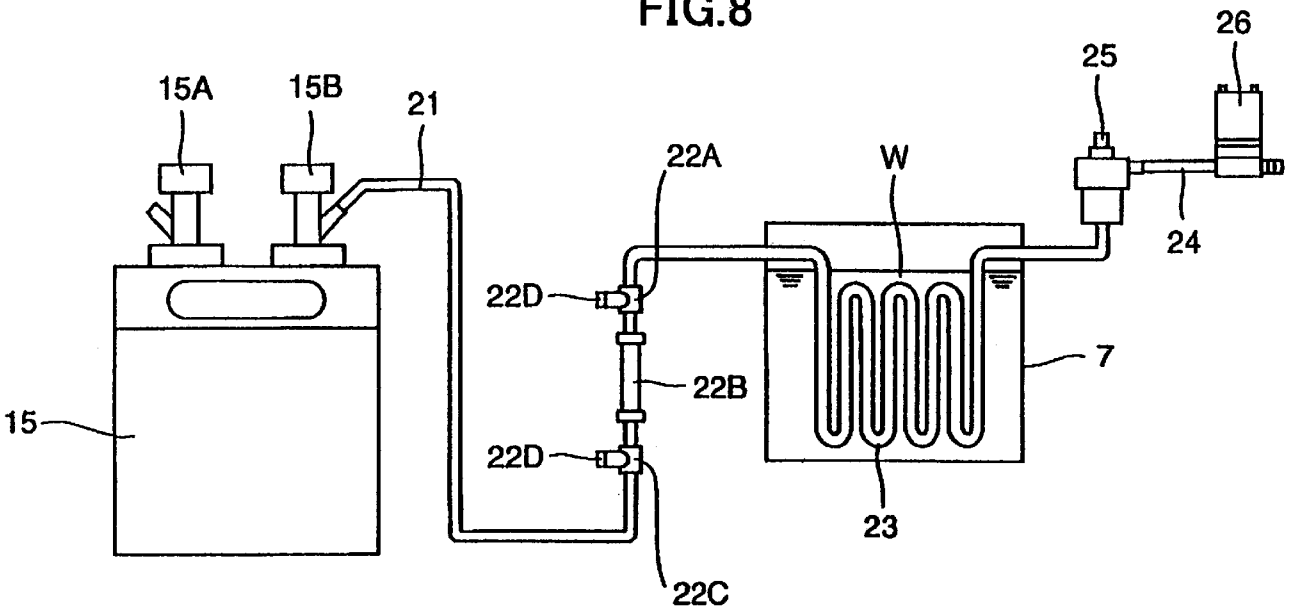
FIG. 8 is an explanatory drawing showing a syrup supplying system of a cup type automatic vending machine which is a third embodiment of the invention.

A syrup supplying system of the third embodiment in the invention is shown in FIG. 8, in which an electrode supporting portion 22D is separated from a case main body and installed in an up-stream side and a down-stream side of the main body 22, whereby piping arrangements can be widely designed without losing passing property and washability of syrup. The pipe connecting portions 22A and 22C can be installed in other positions than the position as shown in FIG. 8, and a plural (e.g. three or four) electrodes can be installed to inspect conditions of syrup in the pipe 21 from an electric flow pattern in each electrode.

A cup type automatic vending machine having the syrup supplying systems is explained in the above embodiments, and a syrup supplying system of drink dispensers can be applied in the invention, in which similar advantages can be provided.

According to the cup type automatic vending machine of the invention, as described above, washability and inspection ability of syrup existence are excellent and construction of the syrup supplying system is more simplified, because the syrup inspecting portion is installed in a fixed position of supplying path and at least a cup of syrup to be sold is stored in the path located in the down-stream of syrup inspecting portion.

What is claimed is:

1. In a cup type automatic vending machine for mixing a syrup drink to be supplied from a syrup storing portion to store the syrup through a supplying path to a supplying nozzle with a diluting water such as drink water or carbonated water and for selling the mixture as a cup type drink, the improvement comprising a syrup inspection portion to inspect existence of the syrup and installed in a fixed position of the supplying path, said supplying path having a syrup supply volume corresponding to a sales volume of at least one cup between the syrup inspection portion and the supplying nozzle.

2. The cup type automatic vending machine according to claim 1, wherein the syrup inspection portion is made so that a cross-section area of a syrup flowing path is not more than three (3) times as large as a cross-section area of the syrup supplying path.

3. A cup type automatic vending machine for mixing a syrup drink with a diluting water, comprising:

a syrup storing portion to store a syrup;

a supplying path connected to the syrup storing portion at one end and to a supplying nozzle at the other end;

a syrup inspection portion disposed in the supplying path to inspect the presence of the syrup, said supplying path having a syrup supply volume corresponding to a sales volume of at least one cup between the syrup inspection portion and the supplying nozzle;

wherein the syrup inspection portion is configured to have a syrup flowing path with a cross-section area not more than three times a cross-section area of the syrup supplying path;

wherein the syrup inspection portion has a pair of electrodes which are extruded in the syrup flowing path and can inspect the presence of the syrup passing in the syrup flowing path by introduction of electricity in the syrup.

4. A cup type automatic vending machine for mixing a syrup drink with a diluting water, comprising:

a syrup storing portion to store a syrup;

a supplying path connected to the syrup storing portion at one end and to a supplying nozzle at the other end;

a syrup inspection portion disposed in the supplying path to inspect the presence of the syrup, said supplying path having a syrup supply volume corresponding to a sales volume of at least one cup between the syrup inspection portion and the supplying nozzle;

wherein the syrup inspection portion is configured to have a syrup flowing path with a cross-section area not more than three times a cross-section area of the syrup supplying path;

wherein the syrup inspection portion has a pair of electrodes, which are extruded in the syrup flowing path and can inspect the presence of the syrup passing in the syrup flowing path by introduction of electricity in the syrup, and has a visible portion in which they syrup passing through the syrup flowing path can be watched by naked eyes.

* * * * *